US005487615A

United States Patent [19]

Hayao

[11] Patent Number: 5,487,615

[45] Date of Patent: Jan. 30, 1996

[54] RIBBON DRIVE ASSEMBLY FOR RIBBON CARTRIDGE

[75] Inventor: Sakae Hayao, Chatsworth, Calif.

[73] Assignee: Sercomp Corporation, Chatsworth, Calif.

[21] Appl. No.: 330,446

[22] Filed: Oct. 28, 1994

[51] Int. Cl.[6] ..... B41J 35/28

[52] U.S. Cl. ..... 400/207; 400/208

[58] Field of Search ..... 400/207, 208, 400/208.1, 197, 200, 196, 196.1, 194, 191

[56] References Cited

U.S. PATENT DOCUMENTS

| | | | |
|---|---|---|---|
| 4,053,042 | 10/1977 | Hess | 400/196 |
| 4,408,914 | 10/1983 | Ciesiel et al. | 400/196 |
| 4,449,838 | 5/1984 | Okamura et al. . | |
| 4,624,592 | 11/1986 | Purcell | 400/196.1 |
| 4,653,947 | 3/1987 | Echols . | |
| 4,741,640 | 5/1988 | Yoshioka | 400/208 |
| 4,913,571 | 4/1990 | Bulson et al. . | |
| 5,005,996 | 4/1991 | Paterra et al. . | |
| 5,215,012 | 6/1993 | Kanno et al. . | |
| 5,248,208 | 9/1993 | Yoshida et al. | 400/208.1 |

FOREIGN PATENT DOCUMENTS

| | | | |
|---|---|---|---|
| 2618379 | 11/1977 | Germany | 400/196.1 |
| 5077536 | 3/1993 | Japan | 400/196.1 |
| 8303798 | 11/1983 | WIPO | 400/197 |

OTHER PUBLICATIONS

"Self-Aligning Ribbon-Stuffing Mechanism" IBM Technical Disclosure Bulletin, vol. 28, No. 9, Feb. 1986.

*Primary Examiner*—Edgar S. Burr
*Assistant Examiner*—Anthony H. Nguyen
*Attorney, Agent, or Firm*—Koda and Androlia

[57] ABSTRACT

A ribbon cartridge for use in impact type printers such as line printers, typewriters an, fie-dot printers. The ribbon cartridge includes a housing having a bottom wall portion, a re-inking assembly provided in a re-inking compartment within the housing for re-inking a ribbon, a ribbon storage compartment for storing the ribbon, and a ribbon drive assembly provided within the housing for advancing the ribbon. The ribbon drive assembly includes a toothed transfer-drive gear assembly and an idler gear assembly for engagement with the toothed transfer-drive gear assembly. In one embodiment of the present invention, the ribbon cartridge has a partition wall separating between the re-inking compartment and the ribbon storage compartment, and the toothed transfer-drive gear assembly has a vertical wall portion defining a part of the partition wall. A first engaging device is provided adjacent the partition wall and affixed to the bottom wall portion of the housing, and a second engaging device provided on the toothed transfer-drive gear assembly for removably engaging the first engaging device.

13 Claims, 5 Drawing Sheets

RIBBON DRIVE ASSEMBLY FOR RIBBON CARTRIDGE

BACKGROUND OF THE INVENTION

1. Field of the Invention

The present invention relates to ribbon cartridges for use in impact type printers such as line printers, typewriters and wire-dot printers and more particularly to a ribbon drive assembly disposed within the cartridge and operative to drive the endless ribbon stored in the cartridge.

2. Prior Art

An impact type printer, such as a typewriter or a wire-dot printer, typically uses a ribbon cartridge storing therein an inked ribbon which is impregnated with ink. Typically, the supply of ink with which the ribbon is impregnated will be depleted long before the ribbon wears out. As the ribbon's supply of ink becomes depleted, print quality becomes increasingly lighter. The print quality finally becomes so light as to be unacceptable, and the ribbon cartridge must be discarded.

A variety of re-inking assemblies have been proposed to re-ink the ribbon to thereby derive further use from the ribbon cartridge. A typical prior art re-inking assembly is mounted in the housing of the ribbon cartridge. The re-inking assembly has a re-inking roller which is formed from a porous material saturated with ink. A transfer roller is mounted for rotation tangentially to the re-inking roller. A ink ribbon drive assembly drives and advances an endless loop ribbon so that the ribbon is brought into contact with a portion of the transfer roller as it is advanced along its path. Ink is transferred from the re-inking roller to the transfer roller and then to the ribbon so that the ribbon is continuously re-inked.

In a typical prior art ink ribbon cartridge, the ink ribbon drive assembly is mounted within the housing of the ink ribbon cartridge and has drive gear meshing with an idler gear. The drive gear and idler gear sandwich the ink ribbon therebetween and engage successive portions of the ribbon to move the ribbon along an endless path of travel and past a printing location located outside the housing where the ribbon is engaged by a printing mechanism. As the internal ink ribbon drive assembly advances the ink ribbon, the ink ribbon is fanfolded or "stuffed" into an ink ribbon storage area inside the cartridge housing.

In one prior art, the ink cartridge housing has a top cover to allow the operator to readily access the inked ribbon, a re-inking assembly, and an ink ribbon drive assembly mounted in the ink cartridge housing. A drive gear is mounted on a bracket which is in turn removably mounted within the ink cartridge housing to facilitate maintenance of the inked ribbon, the re-inking assembly and the ink ribbon drive assembly.

The ink ribbon cartridge is designed so that the bracket of the drive gear is somewhat retained between the top cover and the cartridge housing when the top cover is attached to the cartridge housing. Such a design results in various difficulties in the maintenance of the internal assemblies, such as replacement of the inked ribbon or other parts. For example, once the top cover is opened, it is difficult to close the top cover with the drive gear bracket in place. Sometimes, the drive gear bracket is lost during the maintenance work.

SUMMARY OF THE INVENTION

It is an object of the embodiments of the present invention to facilitate the maintenance of internal assemblies mounted within an ink ribbon cartridge.

It is another object of the embodiments of the present invention to provide an improved ribbon drive assembly structure which is mounted with an ink ribbon cartridge.

It is a further object of the embodiments of the present invention to provide a ribbon re-inking apparatus for use in a ribbon cartridge for printers.

The above objects are accomplished by a unique structure for a ribbon drive assembly used in a ribbon cartridge, and the ribbon drive assembly includes a lock device to retain the ribbon drive assembly to the ribbon cartridge housing. More specifically, the ribbon cartridge includes a housing having a bottom wall portion, a re-inking assembly provided in a re-inking compartment inside the housing for re-inking a ribbon, a ribbon storage compartment for storing the ribbon, and a ribbon drive assembly provided within the housing for advancing the ribbon. The ribbon drive assembly includes a toothed transfer-drive gear assembly and an idler gear assembly for engagement with the toothed transfer-drive gear assembly. In addition, the ribbon cartridge has a partition wall separating between the re-inking compartment and the ribbon storage compartment, and the toothed transfer-drive gear assembly has a vertical wall portion defining a part of the partition wall. A first engaging device is provided adjacent the partition wall so as to project from the bottom wall of the housing, and a second engaging device is provided on the toothed transfer-drive gear assembly for removably engaging the first engaging device.

Other objects, features, and advantages of the present invention will become apparent upon the reading the following specification when taken in conjunction with the accompanying drawings and the appended claims.

DETAILED DESCRIPTION OF THE PREFERRED EMBODIMENTS

Figure 1:
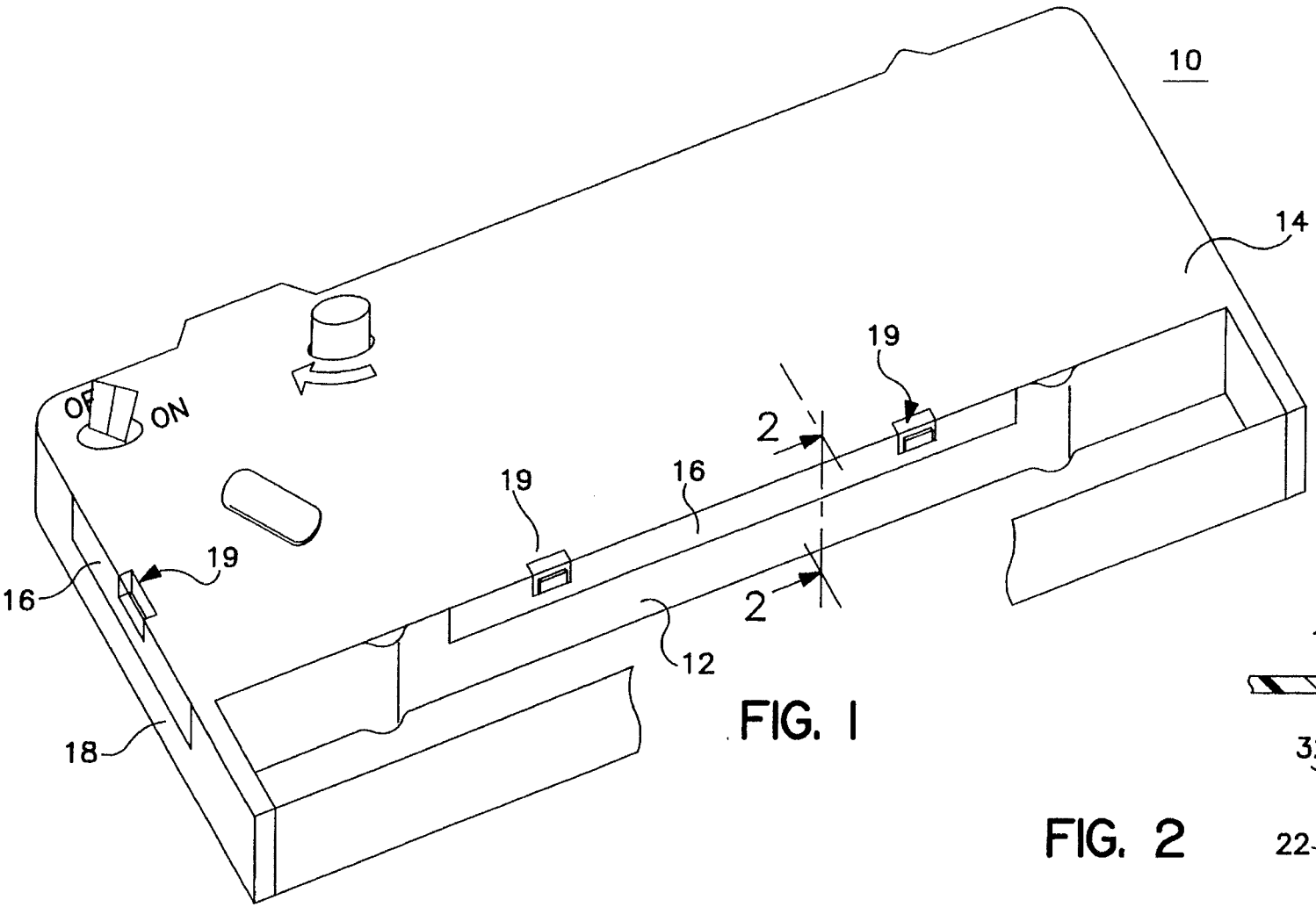
FIG. 1 is a perspective view of the exterior of a ribbon cartridge in accordance with an embodiment of the present invention.

FIG. 1 shows a ribbon cartridge in accordance with one embodiment of the present invention which is indicated generally at 10.

The ribbon cartridge 10 comprises a casing formed of molded plastic or other suitable material, and the casing comprises a bottom housing 12 and a top cover 14. The top cover 14 is removably mounted to the top of the bottom housing 12. In the illustrated embodiment, the top cover 14 has side walls 16 which extend over side walls 18 of the bottom housing 12.

Figure 2:
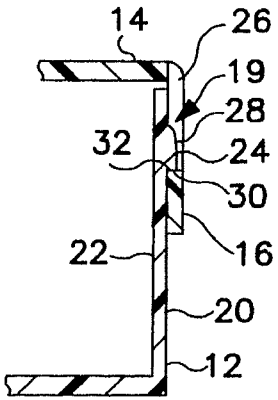
FIG. 2 is a cross-sectional view taken along the lines 2—2 in FIG. 1.

Lock devices 19 are provided along the side walls 18 of the bottom housing 12. As best shown in FIG. 2, the side wall 18 of the bottom housing 12 has an external surface 20 and an interior surface 22. Each lock device 19 comprises a wedge-like protrusion 24 provided on the external surface 20 of the side wall 18 and an opening 24 defined in the side wall 16 of the top cover 14. The wedge-like protrusion 24 has a curved shoulder portion 28 and a downwardly facing edge portion 30. The opening 24 has an upwardly facing edge portion 32 which engages the downwardly facing edge portion 30 when the top cover 14 is fitted on the bottom housing 12.

Figure 3:
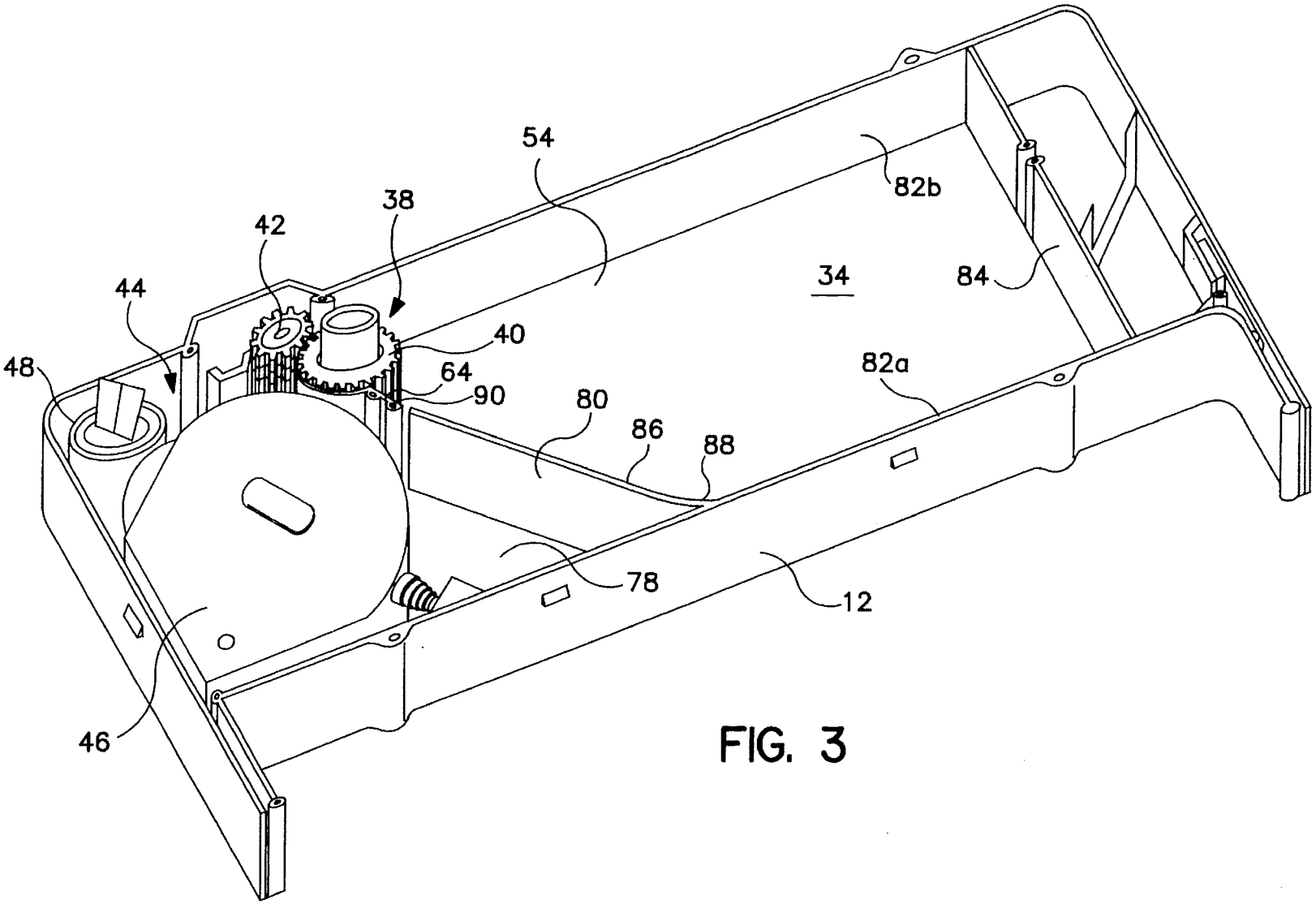
FIG. 3 is a perspective view of the interior of a ribbon cartridge in accordance with the embodiment of the present invention.
Figure 4:
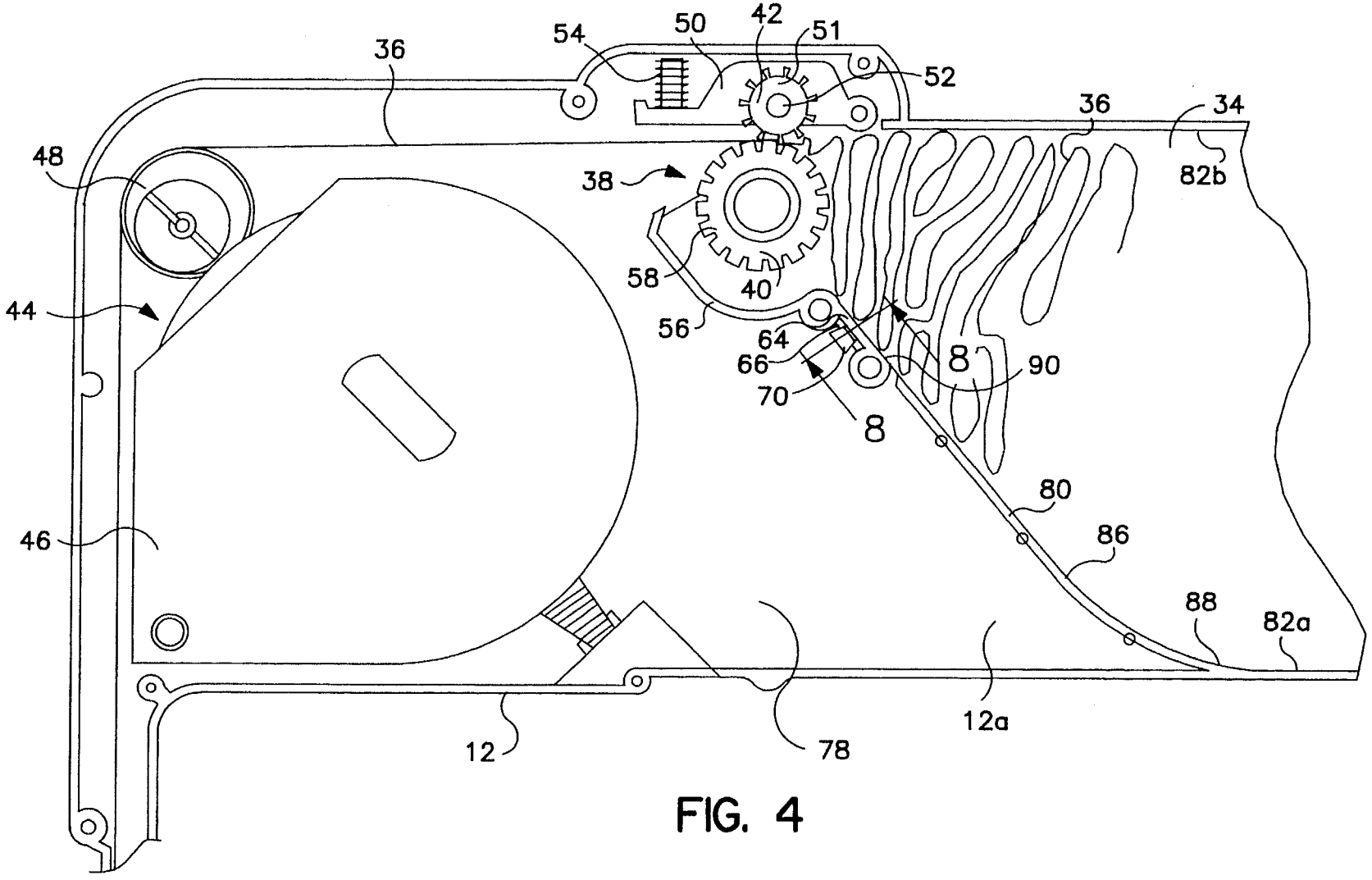
FIG. 4 is a plan view of a ribbon drive assembly in accordance with the embodiment of the present invention.
Figure 5:
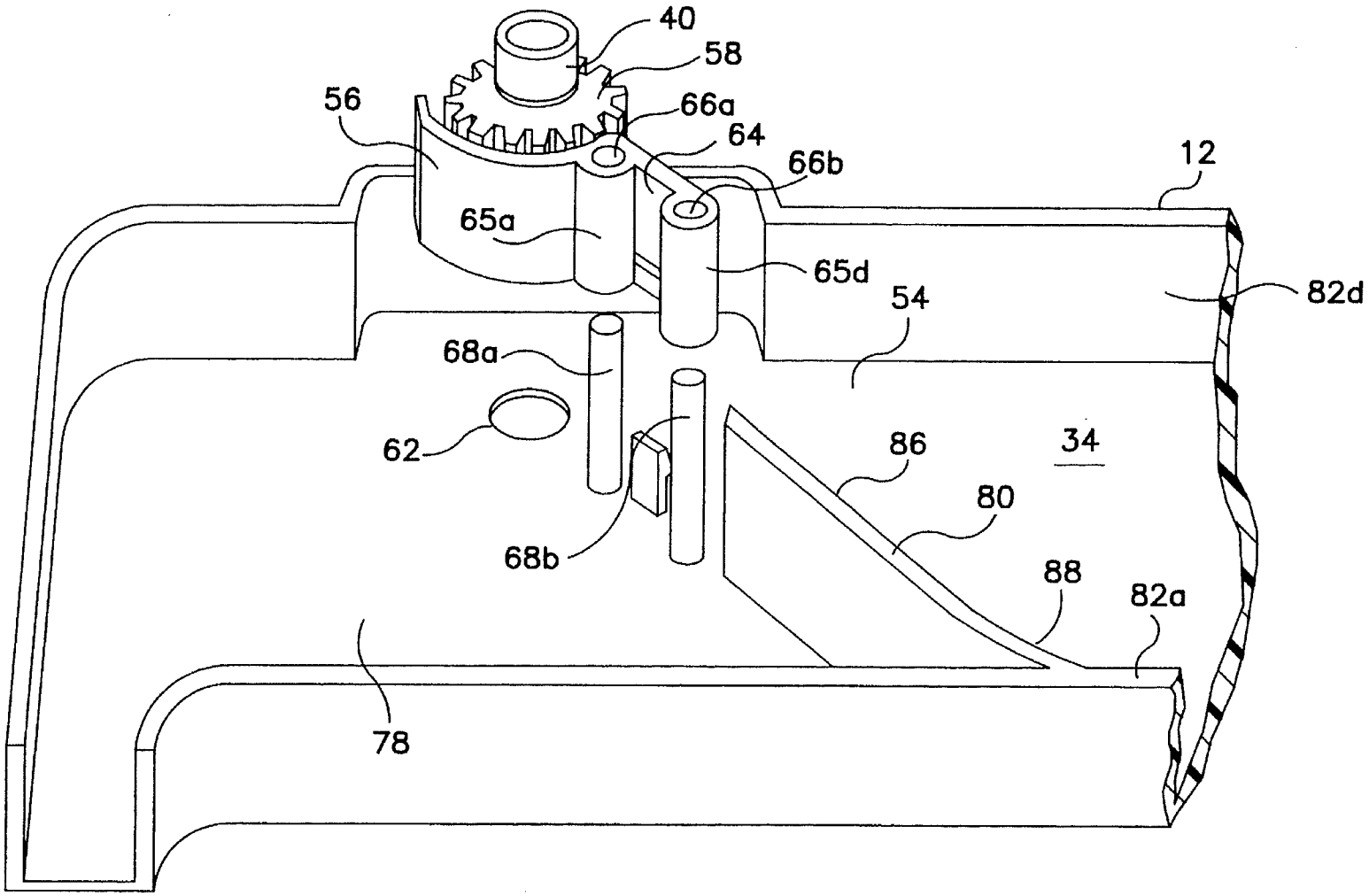
FIG. 5 is a perspective view of a ribbon drive gear assembly in accordance with the embodiment of the present invention.
Figure 6:
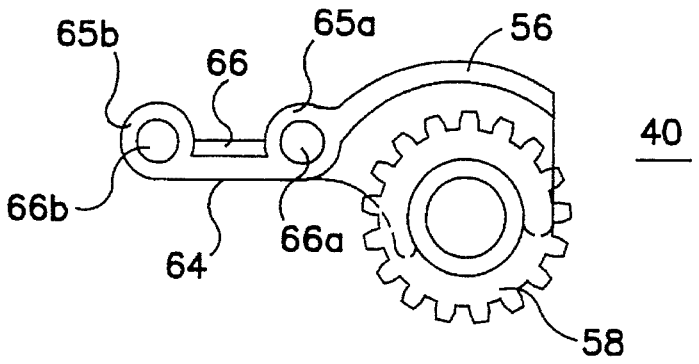
FIG. 6 is a plan view of the ribbon drive gear assembly shown in FIG. 5.
Figure 7:
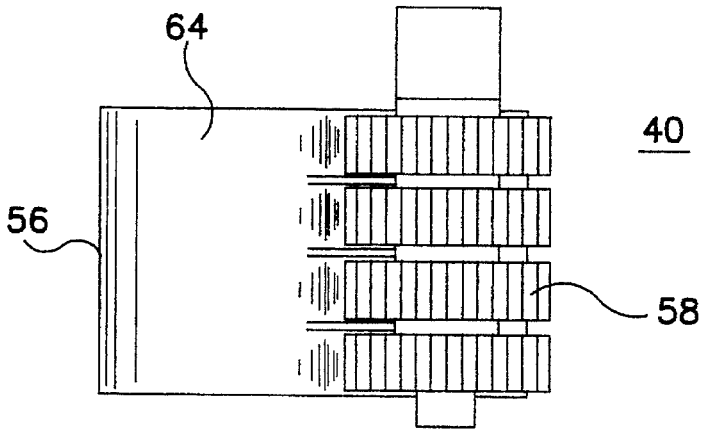
FIG. 7 is a side view of the ribbon drive gear assembly shown in FIG. 5.

As shown in FIGS. 3 and 4, the bottom housing 12 includes a ribbon storage compartment 34 for storing a ribbon 36 (not shown in FIG. 3). As best shown in FIG. 4, the ribbon 36 may be stuffed and stored in a plurality of loops. A ribbon drive assembly 38 is installed in the ribbon cartridge 10. The ribbon drive assembly 38 comprises a toothed transfer-drive gear assembly 40 and a toothed idle gear assembly 42 which engages the toothed transfer-drive gear assembly 40. The ribbon 36 is fed between the nip of the toothed transfer-drive gear assembly 40 and the toothed idle gear assembly 42 and advanced along its path into the ribbon storage compartment 34.

The ribbon cartridge 10 is provided with a re-inking assembly 44 for re-inking the ribbon 36. The re-inking assembly 44 includes a re-inking roller assembly 46 and an ink-transfer roller assembly 48 which is positioned opposite the re-inking roller assembly 46. The ribbon 36, which is drawn into the interior of the cartridge housing, is positioned on the outer side of the transfer roller assembly 48 opposite the re-inking roller assembly 46, and extends to the nip of the toothed transfer-drive gear assembly 40 and the toothed idle gear assembly 42 of the ribbon drive assembly 30.

As shown in FIG. 4, the toothed idle gear assembly 42, in accordance with one embodiment as shown in FIG. 4, includes a bracket 50 and an idle gear 51 rotatably mounted on the bracket 50. The bracket 50 is pivotally mounted on a pin 52 extending from a bottom wall 12*a* of the bottom housing 12. The bracket 50 is normally biased toward the toothed transfer-drive gear assembly 40 by a biasing device, such as a coil spring 54.

Referring to FIGS. 4 through 7, the toothed transfer-drive gear assembly 40 includes a bracket 56 and a drive gear 58 rotatably mounted on the bracket 56. The drive gear 58 has a lower coupling extension 60 (see FIG. 7) which extends through an opening 62 (see FIG. 5) provided in the bottom wall 12*a* of the bottom housing 12. The lower coupling extension 60 engages an external drive mechanism of the printer (not shown) which rotates the drive gear 58. The bracket 56 has a substantially vertical wall 64 and a pair of columns 65*a* and 65*b* which are provided in the vertical wall 64 and spaced a distance from each other. The columns 65*a* and 65*b* define cylindrical bores 66*a* and 66*b*, respectively.

A pair of posts 68*a* and 68*b* are spaced a distance from each other and extend from the bottom wall 12*a* of the bottom housing 12. The posts 68*a* and 68*b* engage the cylindrical bores 66*a* and 66*b*, respectively, to thereby guide the bracket 56 along the posts 68*a* and 68*b* as the bracket 56 is pushed downwardly.

Figure 8:
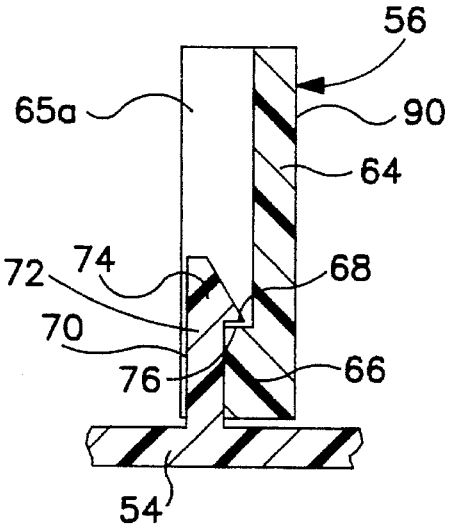
FIG. 8 is a cross-sectional view of the drive gear assembly and the hook member taken along the lines 8—8 of FIG. 4.

In accordance with one embodiment of the present invention, as seen in FIG. 8, the bracket 56 includes a step-like beam portion 66 extending between the columns 65*a* and 65*b*. The beam portion 66 has an upwardly facing horizontal shoulder portion 68. On the other hand, a hook device 70, comprising a projection 72 provided with a hook 74, extends from the bottom wall 12*a* of the bottom housing 12. In a preferred embodiment, the projection 72 of the hook device 70 is flexible and can be flexed between an engaging position where a downwardly facing horizontal edge 76 of the hook 74 engages the upwardly facing shoulder portion 68 of the beam portion 66 and a disengaging position where the hook 74 disengages from the beam portion 66. Although the projection 72 is flexible, the projection 72 should have a sufficient degree of rigidity so that the hook 74 does not readily or inadvertently come off the beam portion 66. When the toothed transfer-drive gear assembly 40 is desired to be removed from the hook device 70, the hook 74 may be flexed away from the beam portion 66 with an appropriate tool or the like.

Referring back to FIGS. 3 through 5, the re-inking assembly 44 is set in a re-inking assembly compartment 78 adjacent the ribbon storage compartment 34. In the illustrated embodiment, the re-inking assembly compartment 78 and the ribbon storage compartment 34 are separated by a partition wall 80.

In one embodiment of the present invention, the ribbon storage compartment 34 is defined by two opposing parallel internal wall surfaces 82*a* and 82*b*, a side wall surface 84 which extends substantially perpendicular to the two opposing parallel internal wall surfaces 82*a* and 82*b*, and a diagonal internal wall surface 86 of the partition wall 80 which diagonally extends with respect to the two opposing parallel internal wall surfaces 82*a* and 82*b*. Preferably, the internal walls 82*a*, 82*b*, 84 and 86 of the ribbon storage compartment 34 are generally flat and smooth to improve the movement of the ribbon 36 within the ribbon storage compartment 34. Also, since the lock devices 19 are provided on the exterior walls of the bottom housing 12, the internal walls of the storage compartment 34 do not have any portions protruding into the ribbon storage chamber 34. Furthermore, a corner 88 between the diagonal internal wall surface 86 and one of the parallel walls 82*a* is rounded. As a result, the movement of the ribbon 36 within the ribbon storage compartment 34 is substantially smoothed out. In the illustrated embodiment, an internal wall surface 90 of the vertical wall portion 64 is continuous and flush with the diagonal internal wall surface 86 of the partition wall 80 and defines a part of the diagonal internal wall surface 86. In the illustrated embodiment, the columns 65*a* and 65*b* are provided on the vertical wall 64 of the transfer-drive gear assembly 40 so that the columns 65*a* and 65*b* are in the re-inking assembly compartment 78 and do not protrude into the ribbon storage compartment 34.

It will be understood that modification of the present invention, in its various aspects, will be apparent to those skilled in the art, some being apparent only after study and others being matters of routine mechanical design. Therefore, the scope of the invention should not be limited by the particular embodiments herein described but should be defined only by the appended claims and equivalents thereof.

I claim:

1. A ribbon cartridge for printers, the ribbon cartridge including a housing having a bottom wall portion, a re-inking assembly provided within the housing for re-inking a ribbon, and a ribbon drive assembly provided within the housing for advancing the ribbon, the improvement comprising:

a first engaging device affixed to the bottom wall portion of the housing; and a second engaging device provided on the ribbon drive assembly for removably engaging the first engaging device; and wherein the ribbon drive assembly includes a bracket and a drive gear rotatably mounted on the bracket, the bracket including a step-like protrusion and the first engaging device having a first hook for engaging with the step-like protrusion of the bracket.

2. A ribbon cartridge as defined in claim 1, wherein the first engaging device includes a flexible projection extending from the bottom wall portion of the housing and provided with the first hook, the flexible projection being flexible between an engaging position at which the first hook engages the step-like protrusion of the bracket and a disengaging position at which the first hook disengages from the step-like protrusion.

3. A ribbon cartridge as defined in claim 2, wherein the bracket includes first and second cylindrical bores and the bottom wall portion defines first and second guide posts extending therefrom for slidably engaging the first and second cylindrical bores of the bracket, respectively, and wherein the step-like protrusion horizontally extend between the first and second cylindrical bores of the bracket and the first engaging device is positioned between the first and second guide posts.

4. A ribbon cartridge as defined in claim 2, wherein the bracket includes a vertical wall portion and first and second cylindrical bores provided in the vertical wall portion and spaced a distance from each other, and the bottom wall portion defines first and second guide posts spaced a distance from each other and extending from the bottom wall portion for slidably engaging the first and second cylindrical bores of the bracket, respectively, and wherein the step-like protrusion horizontally extend between the first and second cylindrical bores of the bracket and the projection provided with the first hook is positioned between the first and second guide posts.

5. A ribbon cartridge for printers, the ribbon cartridge including a housing having a bottom wall portion, a re-inking assembly provided in a re-inking compartment within the housing for re-inking a ribbon, a ribbon storage compartment for storing the ribbon, and a ribbon drive assembly provided within the housing for advancing the ribbon, the ribbon drive assembly having a drive transfer gear assembly, the improvement comprising:

a partition wall separating between the re-inking compartment and the ribbon storage compartment, the drive transfer gear assembly having a vertical wall portion defining a portion of the partition wall;

a first engaging device adjacent the partition wall and affixed to the bottom wall portion of the housing; and a second engaging device provided on the drive gear assembly for engaging the first engaging device; and wherein the first engaging device includes a flexible projection extending from the bottom wall portion of the housing and provided with a first hook, and the drive gear assembly includes a step-like protrusion in the vertical wall portion thereof, the flexible projection being flexible between an engaging position at which the first hook engages the step-like protrusion of the vertical wall portion of the drive gear assembly and a disengaging position at which the first hook disengages from the step-like protrusion.

6. A ribbon cartridge as defined in claim 5, wherein the drive gear assembly includes first and second columns provided in the vertical wall portion and spaced a distance from each other, each of the first and second columns defining a cylindrical bore, and the bottom wall portion defines first and second guide posts spaced a distance from each other and extending from the bottom wall portion for slidably engaging the bores of the first and second columns, respectively, and wherein the step-like protrusion horizontally extends between the first and second columns of the drive gear assembly and the flexible projection provided with the first hook is positioned between the first and second guide posts.

7. A ribbon cartridge as defined in claim 6, wherein the vertical wall portion of the drive gear assembly includes a first surface facing the ribbon storage compartment and a second surface facing the re-inking compartment, and wherein the first and second columns are provided on the second surface of the vertical wall portion.

8. A ribbon cartridge as defined in claim 7, wherein the ribbon storage compartment has a side peripheral internal wall, and the first surface of the vertical wall portion of the drive gear assembly is substantially continuous and flush with the side peripheral internal wall of the ribbon storage compartment.

9. A ribbon cartridge as defined in claim 7, wherein the ribbon storage compartment has a side peripheral internal wall which is flat and smooth, and the first surface of the vertical wall portion of the drive gear assembly is substantially continuous and flush with the side peripheral internal wall of the ribbon storage compartment.

10. In a ribbon cartridge for printers, the ribbon cartridge including a housing having a bottom wall portion, a re-inking assembly provided in a re-inking compartment within the housing for re-inking a ribbon, a ribbon storage compartment for storing the ribbon, and a ribbon drive assembly provided within the housing for advancing the ribbon, the ribbon drive assembly having a drive transfer gear assembly and an idler gear assembly for engagement with the drive transfer gear assembly, the improvement comprising:

the ribbon storage compartment having two substantially flat and smooth opposing internal wall surfaces extending substantially in parallel with each other, a substantially flat and smooth side internal wall surface substantially perpendicularly transversing the two opposing parallel internal wall surfaces and a substantially flat and smooth diagonal internal wall surface diagonally transversing the two opposing parallel wall surfaces, the diagonal internal wall surface separating the ribbon storage compartment from the re-inking compartment;

the drive transfer gear assembly having a vertical wall portion including an internal vertical surface defining a part of the diagonal internal wall surface;

a first engaging device provided on the bottom wall of the housing so as to be adjacent the diagonal internal wall surface; and a second engaging device provided on the drive gear assembly for removably engaging the first engaging device.

11. A ribbon cartridge as defined in claim 13, wherein the first engaging device includes a flexible projection extending from the bottom wall portion of the housing and provided with a first hook, and the drive gear assembly includes a step-like protrusion in the vertical wall portion thereof, the flexible projection being flexible between an engaging position at which the first hook engages the step-like protrusion of the vertical wall portion of the drive gear assembly and a disengaging position at which the first hook disengages from the step-like protrusion.

12. A ribbon cartridge as defined in claim 11, wherein the drive gear assembly includes first and second cylinders provided in the vertical wall portion and spaced a distance from each other, each of the first and second cylinders defining a cylindrical bore, and the bottom wall portion of the housing defines first and second guide posts spaced a distance from each other and extending from the bottom wall portion of the housing for slidably engaging the bores of the first and second cylinders, respectively, and wherein the step-like protrusion horizontally extends between the first and second cylinders of the drive gear assembly, and the projection provided with the first hook is positioned between the first and second guide posts.

13. A ribbon cartridge as defined in claim 12, wherein the vertical wall portion of the drive gear assembly includes a rear surface facing the re-inking compartment, and wherein the first and second columns are provided on the rear surface of the vertical wall portion.

* * * * *